US006223121B1

(12) United States Patent
Ishida et al.

(10) Patent No.: US 6,223,121 B1
(45) Date of Patent: Apr. 24, 2001

(54) AIR-TO-FUEL RATIO CONTROL DEVICE

(75) Inventors: Akira Ishida, Osakafu; Masuo Takigawa, Naraken; Toru Kitamura, Saitama-ken; Akira Kato, Saitama-ken; Naohiro Kurokawa, Saitama-ken, all of (JP)

(73) Assignees: Matsushita Electric Industrial Co., Osaka; Honda Giken Kogoyok Kabushiki Kaisha, Tokyo, both of (JP)

( * ) Notice: Subject to any disclaimer, the term of this patent is extended or adjusted under 35 U.S.C. 154(b) by 0 days.

(21) Appl. No.: 09/245,022

(22) Filed: Feb. 5, 1999

(30) Foreign Application Priority Data

Feb. 6, 1998 (JP) ..... 10-026178
Feb. 6, 1998 (JP) ..... 10-026180

(51) Int. Cl.[7] ..... F02D 45/00

(52) U.S. Cl. ..... 701/113; 701/104; 701/103; 123/480; 123/494

(58) Field of Search ..... 123/480, 491, 123/494, 492, 493; 701/104, 103, 106, 109, 113

(56) References Cited

U.S. PATENT DOCUMENTS 5,361,213 11/1994 Fujieda et al. ..... 701/111
5,925,089 * 7/1999 Fujime ..... 701/106
5,954,783 * 9/1999 Yamaguchi et al. ..... 701/106
5,957,993 * 9/1999 Frigoli et al. ..... 701/104

FOREIGN PATENT DOCUMENTS 3-235723 10/1991 (JP) .

OTHER PUBLICATIONS

"Neural Network Control of Automotive Fuel–Injection Systems", IEEE Control Systems, Jun. 1994, pp. 31–36.

* cited by examiner

*Primary Examiner*—Henry C. Yuen
*Assistant Examiner*—Hieu T. Vo
(74) *Attorney, Agent, or Firm*—Wenderoth, Lind & Ponack, L.L.P.

(57) ABSTRACT

A control device for controlling an air-to-fuel ratio when fuel is injected in an internal combustion engine, comprises: a state detecting unit for detecting parameters representing operating states of the internal combustion engine; a counting unit for counting the number of times of explosion in a cylinder just after the engine starts; and a unit for estimating an air-to-fuel ratio just after the engine starts from the operating state parameters and the number of times of explosion.

11 Claims, 9 Drawing Sheets

AIR-TO-FUEL RATIO CONTROL DEVICE

FIELD OF THE INVENTION

The present invention relates to a gasoline engine (internal combustion engine) of a fuel injection control type. More particularly, the present invention relates to an improved air-to-fuel ratio control device which is capable of controlling an air-to-fuel ratio of the engine by applying a neural network which stores knowledge(information) and operates adaptively to aims or environments.

BACKGROUND OF THE INVENTION

In the past, for air-to-fuel (A/F) ratio control of an automobile fuel injection system, feedback control was generally performed by an $O_2$ sensor or a linear A/F ratio sensor (LAF sensor) as an A/F ratio sensor, and was successful in stationary-state operation (idle-state operation). However, during a transient state in which its speed is accelerating or decelerating, response-delays in the sensor causes the A/F ratio to be controlled with low precision, and thereby a target A/F ratio cannot be achieved. To correct this, depending upon mechanical change such as change of the degree of throttle opening, fuel is subjected to increasing/reducing correction. In this case, however, all the injected fuel does not flow into a cylinder but is deposited on a wall of an intake manifold pipe or an air suction valve, and some of the fuel deposit thereon evaporates and enters the cylinder, which makes it difficult to control the A/F ratio during the transient state in which the speed is accelerating or decelerating the engine is starting.

To pass a ULEV (Ultra Low Emission Vehicle) regulation in the United States of America, it is essential that the A/F ratio be controlled with high precision during the transient state at the starting of the engine, since quantity of HC (hydrocarbon) released during this state occupies about 80% of all in the test mode.

With a view to attaining the above object, a fuel deposit model is constructed and correction quantity of the fuel is found by an inverse system of this model, or as described in Japanese patent publication No. 3-235723, a neural network (NN) is made to learn nonlinearities such as the fuel deposit, to improve response characteristics during the transient state. In the NN, "units" which perform calculations are connected by a weighted "directional link" to construct the same, and the units respectively transmit their outputs through the link to perform information processing. Since the network system stores knowledge (information) in itself and operates adaptively to aims or environments, the A/F ratio could be controlled precisely during the transient state through the use of the network.

The prior art A/F ratio control device is thus constructed. In the internal combustion engine, all of the fuel injected by an injector does not flow into the cylinder but a part of it is deposited on the wall of the intake manifold pipe as described above. The quantity of the fuel deposited thereon varies intricately depending upon operating states (number of engine revolutions or load such as an intake air pressure) or environments (intake air temperature or cooling water temperature, atmospheric pressure, and the like), and the quantity of the evaporated fuel also varies depending upon the operating states or the environments. Hence, if the quantity of the fuel flowing into the cylinder is known, then it becomes possible to control the A/F ratio more precisely particularly during the transient state. However, use of the above deposit model cannot represent such a complicated system and only provides approximation. As a consequence, satisfactory A/F ratio control is not realized.

In a control system using the NN, it is possible to learn complicated behavior. To obtain a generalized estimation value, it is required that the output of the A/F ratio sensor be supplied to the NN as an input. In actuality, however, when the A/F ratio sensor is deactivated at very low temperature or just after the engine starts, it is impossible to perform correction control by the use of the NN which performs calculations on the output value of the sensor as input data, and it is therefore extremely difficult to estimate a generalized and highly precise A/F ratio.

SUMMARY OF THE INVENTION:

It is an object of the present invention to provide an air-to-fuel ratio control device which is capable of predictively estimating the quantity of injected fuel during a transient state at the starting of the engine and calculating the quantity of the injected fuel from the estimation, and thereby controlling an air-to-fuel ratio with high precision, with a neural network which does not receive the output of an air-to-fuel ratio sensor as an input.

It is another object of the present invention to provide an air-to-fuel ratio control device which is capable of constructing a neural network engine model which represents dynamic characteristics of the transient state at the starting of the engine and controlling the quantity of injected fuel based on the model so that a target (desired) air-to-fuel ratio is achieved.

It is still another object of the present invention to provide an air-to-fuel control device which is capable of reliably controlling an air-to-fuel ratio without being affected by disturbance and the like during the transient state.

Other objects and advantages of the invention will become apparent from the detailed description that follows. The detailed description and specific embodiments described are provided only for illustration since various additions and modifications within the spirit and the scope of the invention will be apparent to those skill in the art from the detailed description.

According to a first aspect of the present invention, a control device for controlling an air-to-fuel ratio when fuel is injected in an internal combustion engine, comprises: a state detecting unit for detecting parameters of operating states of the internal combustion engine; a counting unit for counting the number of times of explosion in a cylinder just after the engine starts; and a unit for estimating an air-to-fuel ratio just after the engine starts from the parameters and the number of times of explosion. Since temperature change in the cylinder is taken into account, the target A/F ratio can be estimated despite the fact that the dynamic characteristic of the A/F ratio is extremely nonlinear.

According to a second aspect of the present invention, a control device for controlling an air-to-fuel ratio when fuel is injected in an internal combustion engine, comprises: a correction parameter calculating unit for calculating a fuel correction parameter at the starting of the engine from fuel injection quantity Toutnn from which a target air-to-fuel ratio is obtained, which has been found with the use of a neuro-engine model representing a dynamic characteristic of an air-to-fuel ratio at the starting of the engine; and a fuel calculating unit for calculating fuel injection quantity at the starting of the engine, from the fuel correction parameter. Thereby, it is possible to perform A/F ratio control in which the A/F ratio at the starting of the engine matches the target A/F ratio.

According to a third aspect of the present invention, a control device for controlling an air-to-fuel ratio when fuel is injected in an internal combustion engine, comprises: a parameter calculating unit for calculating fuel deposit parameters at the starting of the engine, based on fuel injection quantity Toutnn from which a target air-to-fuel ratio is obtained, which has been found by the use of a neuro-engine model representing a dynamic characteristic of an air-to-fuel ratio at the starting of the engine and an intake manifold pipe deposit model at the starting of the engine; and a fuel calculating unit for calculating fuel injection quantity at the starting of the engine, based on the fuel deposit parameters and the intake manifold pipe deposit model. Therefore, it is possible to uniquely determine the fuel injection quantity so that the quantity of the fuel flowing into the cylinder is equal to the target quantity of fuel flowing into the cylinder (combustion result A/F=target A/F).

According to a fourth aspect of the present invention, in the control device of the third aspect, the parameter calculating unit derives parameters of a cylinder deposit model at the starting of the engine, with the use of a neuro-engine model representing a dynamic characteristic of the air-to-fuel ratio at the starting of the engine, and the fuel calculating unit calculates the fuel injection quantity at the starting of the engine, based on parameters of intake manifold pipe deposit and the parameters of cylinder deposit as the fuel deposit parameters at the starting of the engine, the intake manifold pipe deposit model, and the cylinder deposit model. Thereby, it is possible to more accurately represent complicated behavior of the engine at the starting and thereby further improve controllability of the A/F ratio.

According to a fifth embodiment of the present invention, in the control device of the fourth aspect, the parameter calculating unit derives the parameters of intake manifold pipe deposit and the parameters of cylinder deposit at the starting of the engine while taking evaporation temperature of gasoline into account, with the use of the neuro-engine model representing the dynamic characteristic of the air-to-fuel ratio at the starting of the engine. Since these models are adapted to physical characteristics, the A/F ratio control can be performed with improved precision. In addition, the number of the derived parameters of the cylinder deposit model can be reduced to simplify the calculation.

According to a sixth aspect of the present invention, a control device for controlling an air-to-fuel ratio when fuel is injected in an internal combustion engine, comprises: a parameter map for storing fuel deposit parameters at the starting of the engine; and a fuel calculating unit for calculating fuel injection quantity from which a target air-to-fuel ratio at the starting of the engine is obtained, from the fuel deposit parameters as time series data. Therefore, the A/F ratio control can be performed stably without being affected by disturbance.

According to a seventh aspect of the present invention, a control device for controlling an air-to-fuel ratio when fuel is injected in an internal combustion engine, comprises: a parameter map for storing deposit parameters at the starting of the engine; a correction coefficient calculating unit for calculating correction coefficients for correcting the fuel deposit parameters at the starting of the engine so that the A/F ratio at the starting of the engine matches the target A/f ratio; and a fuel calculating unit for calculating fuel injection quantity at the starting of the engine, based on the fuel deposit parameters, the correction coefficients, and the fuel deposit model. Therefore, it is possible to control the A/f ratio and improve toughness of the A/f ratio control even if the operating states might change during the transient state at the starting of the engine.

DETAILED DESCRIPTION OF THE PREFERRED EMBODIMENTS

Now, a description will be given of an air-to-fuel ratio control device according to a first embodiment of the present invention.

Embodiment 1.

Figure 1:
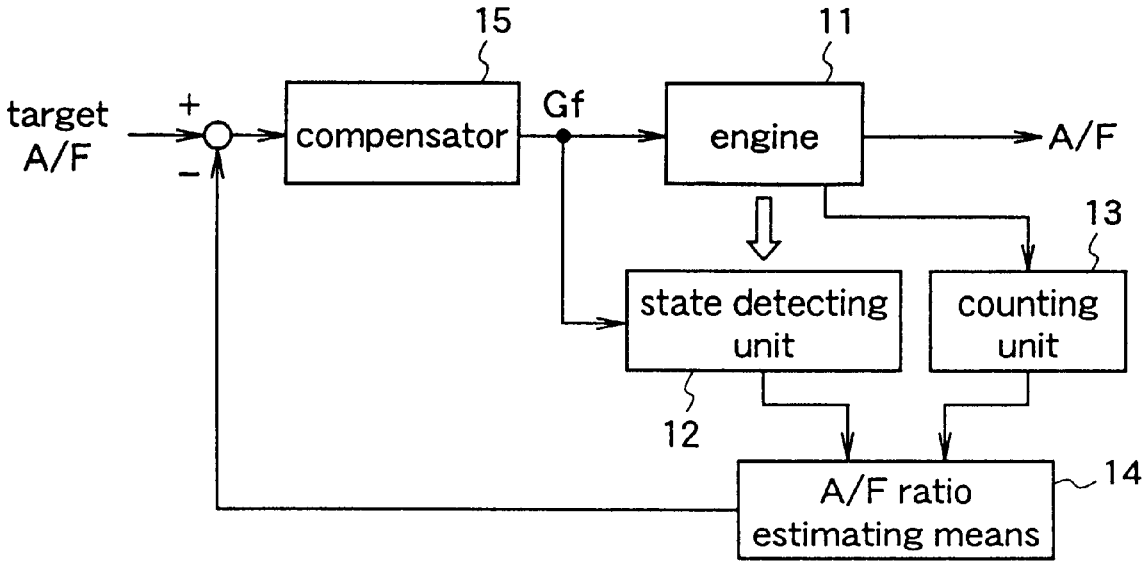
FIG. 1 is a functional block diagram showing an air-to-fuel ratio control device according to a first embodiment of the present invention.

FIG. 1 is a functional block diagram showing the air-to-fuel (A/F) ratio control device according to the first embodiment of the present invention.

Since the value of the A/F ratio just after the engine starts significantly affects a rapid change of temperature in a cylinder, an input relating to the temperature change must be added. The first embodiment pays attention to the fact that the temperature change (rise in temperature) depends upon how many times an explosion occurs in the clylinder, and uses the number of times of cranking just after the engine starts, i.e., "Tcount" as a parameter indicating how many times an explosion occurs in the cylinder.

Turning now to FIG. 1, reference numeral 11 designates a gasoline engine as an internal combustion engine, 12 designates a state detecting unit for detecting operating states of the engine 11, and 13 designates a counting unit for counting the number of times of cranking. In actuality, a crank angle sensor provided in the fuel injection internal combustion engine serves as the counting unit 13 and is adapted to detect TDCs (top dead centers) of a piston. Reference numeral 14 designates means for estimating the A/F ratio (estimating means) at the starting of the engine 11 based on parameters and 15 designates a compensator for calculating fuel injection quantity so that a target A/F ratio is obtained.

Operation will be described below. In order to estimate the A/F ratio at the starting of the engine 11, the state detecting unit 12 detects parameters indicating operating states of the internal combustion engine, i.e., fuel injection quantity Gf, an intake air pressure Pb, number of engine revolutions Ne, and cooling water temperature TW, and the counting unit 13 counts the number of times of cranking just after the engine starts, that is, it detects Tcount.

Based on these five parameters, the estimating means 14 estimates the A/F ratio at the starting of the engine 11, and the compensator 15 calculates the fuel injection quantity so that the estimated A/F ratio value agrees with the target A/f ratio. In this manner, the A/F ratio at the starting of the engine 11 is controlled.

Figure 2:
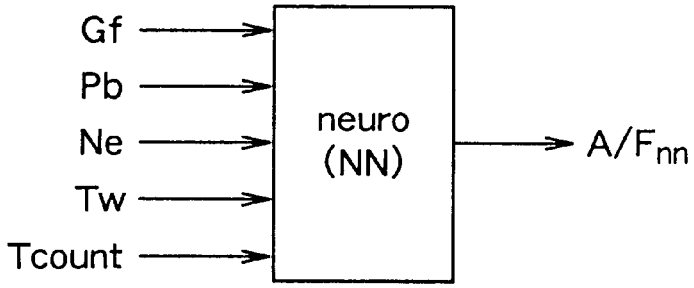
FIG. 2 is a diagram showing a case where means for setting the air-fuel-ratio of the control device according to the first embodiment of the present invention is constructed by the use of a neural network.

As shown in FIG. 2, the estimating means 14 may estimate the A/f ratio by the use of a neural network (NN) which receives the operating state parameters (Gf, Pb, Ne, TW) and Tcount as input parameters and outputs the A/F ratio (A/Fnn). In this case, use of time series data of the operating state parameters as the input data to the NN improves precision in estimating the A/F ratio for the transient state.

While in the first embodiment, the crank angle sensor is used as the count detecting unit 13 for detecting the TDC, a cylinder pressure sensor for measuring pressures in the cylinder may be alternatively used. Use of the cylinder pressure sensor can detect an explosion in the cylinder more accurately, because the TDC might be detected even when a misfire occurs, and thereby the A/F ratio can be controlled with high precision and reliability.

Thus, in accordance with the first embodiment, provided are the operating state detecting unit 12 for detecting the operating state parameters, the counting unit 13 for counting the number of times of explosion in the cylinder just after the engine 11 starts, and the means 14 for estimating the A/F ratio immediately after the engine 11 starts, for associating the rise in temperature in the intake manifold pipe with the number of times of explosion in the cylinder. Therefore, with a neuro-engine model for the transient state which does not receive the output of the A/F ratio sensor as the input, it is possible to predictively estimate the A/F ratio for the transient state, which is to be used to calculate the fuel injection quantity for the transient state, and thereby control the A/F ratio with high precision during the transient state.

Embodiment 2.

A description will be given of an A/F ratio control device according to a second embodiment of the present invention.

In a control system using an NN which outputs the A/F ratio, feedback control is performed so as to make deviation between the A/F ratio and the target A/F ratio "zero". The problem associated with this case is that there is no theoretical methodology for setting stable control gain and therefore the control gain needs to be adjusted by desk simulation and repeating automobile experiments.

Hence, in the second embodiment, the dynamic characteristic of the A/f ratio at the starting of the engine is learned, and the resulting NN engine model is used to calculate the fuel injection quantity so that the target A/F ratio is obtained.

This calculating method will be described below.

Figure 3:
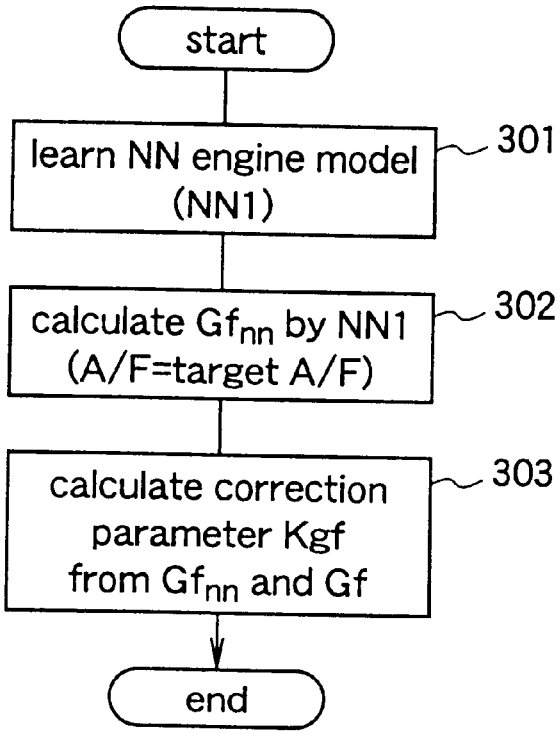
FIG. 3 is a flowchart showing flow of calculation of correction parameters at the starting of the engine, in the air-fuel-ratio control device according to a second embodiment of the present invention.

FIG. 3 is a flowchart showing a procedure for calculating a fuel correction parameter Kgf for the transient state at the starting of the engine, in the A/F ratio control device of the third embodiment.

In Step 301, a neuro-engine model which outputs the A/F ratio representing a dynamic characteristic of the A/F ratio for the transient state is learned. In Step 302, based on the neuro-engine model and evaluation data of the automobile, a target fuel injection quantity $Gf_{nn}$ is calculated so that the target A/f ratio is obtained.

In Step 303, from the target fuel injection quantity $Gf_{nn}$ and the fuel injection quantity Gf of the evaluation data, the correction parameter Kgf is calculated. The neuro-engine model may be a neural network NN1 which outputs the A/F (see FIG. 4(*a*)) or a neural network NN2 which outputs the fuel injection quantity Gf (see FIG. 4(*b*)).

Figure 4:
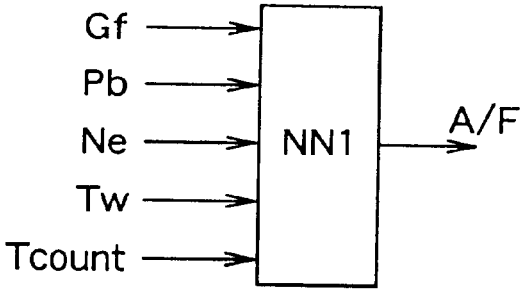
FIGS. 4(*a*) and 4(*b*) are diagrams showing a neuro-engine model of the air-fuel ratio control device of the second embodiment.
Figure 4:
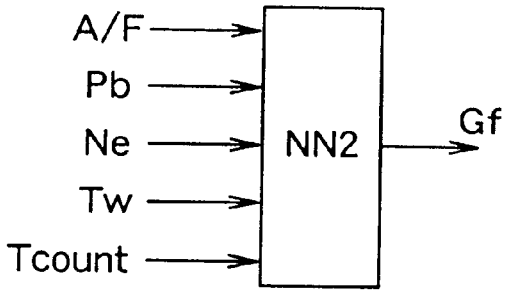
Figure 5:
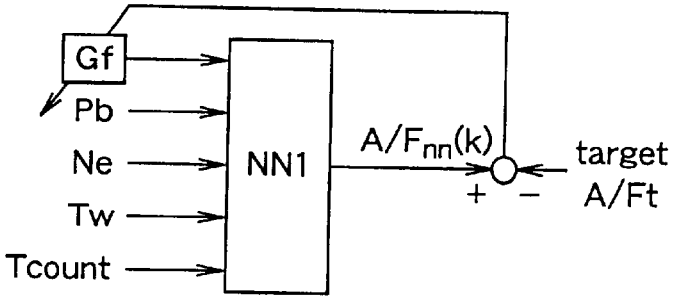
FIGS. 5(*a*) and 5*b*) are diagrams for explaining a method for deriving a target quantity of injected fuel of the air-fuel-ratio control device of the second embodiment.
Figure 5:
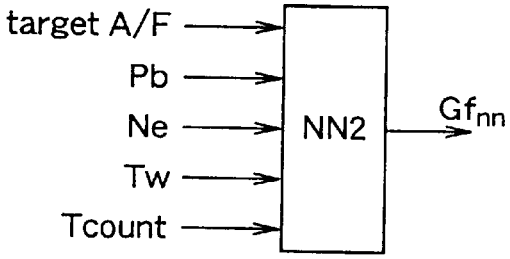

FIGS. 5(*a*) and 5(*b*) show methods for deriving the target fuel injection quantity $Gf_{nn}$ by the use of the neuro-engine models shown in FIGS. 4(*a*) and 4(*b*), respectively.

FIG. 5(*a*) illustrates the method for calculating the target fuel injection quantity $Gf_{nn}$ by the use of the neural network NN1 whose output has been learned as the A/F ratio. The fuel injection quantity Gf input to the neural network NN1 is corrected so that the output A/Fnn(k) of the neural network NN1 using an input data string at time k agrees with the target A/F ratio, A/Ft, to obtain the target fuel injection quantity (k).

In the example illustrated in FIG. 5(*b*), since the neural network 2 outputs the fuel injection quantity Gf, the A/F ratio as the input data is changed into the target A/F ratio A/Ft, which is input to the neural network NN2, and thereby the target fuel injection quantity $Gf_{nn}$ as the output of the neural network NN2 is calculated.

The target fuel injection quantity $Gf_{nn}$ is calculated by any of the above methods. The correction parameter Kgf for correcting the fuel injection quantity Gf is calculated by means of the following expression:

$$Kgf=Gfnn/Gf$$

Figure 6:
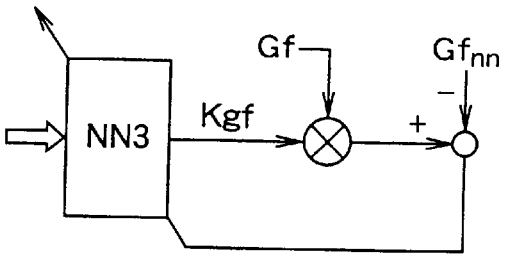
FIG. 6 is a diagram for explaining a learning method of the neural network which outputs correction parameters of the A/F ratio control device according to the second embodiment.
Figure 7:
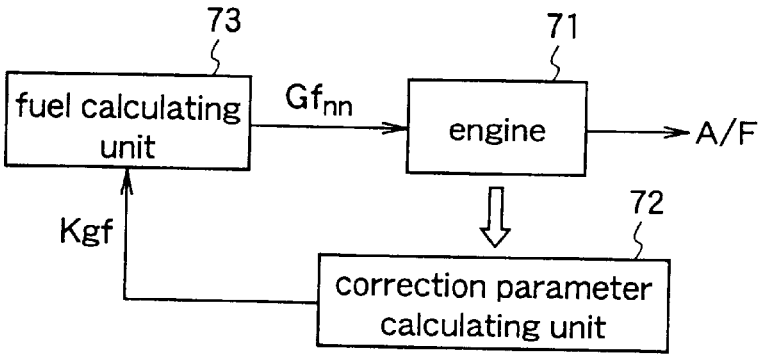
FIG. 7 is a functional block diagram showing construction of a control system using a neural network which outputs correction parameters in the A/F ratio control device of the second embodiment.

Alternatively, a method for calculating the correction parameter Kgf as the output of the neural network may be employed. FIG. 6 shows a learning method of a neural network NN3 which outputs the correction parameter Kgf. FIG. 7 shows construction of a control system using the neural network NN3.

As shown in FIG. 7, an engine 71 detects operating state parameters , and a unit 72 for calculating a correction parameter performs neuro-calculations of the neural network NN3 to obtain the correction parameter Kgf. A fuel calculating unit 73 calculates the target fuel injection quantity $Gf_{nn}$ from the correction parameter Kgf.

In a case where the correction parameter Kgf is given as a map value such as the time series data, the calculating means 72 performs map retrieval.

With the construction described above, it is possible to uniquely calculate the fuel injection quantity so that the target A/F ratio is obtained.

Embodiment 3.

A description will be given of an A/F ratio control device according to a third embodiment of the present invention.

As mentioned previously, all the injected fuel does not flow into the cylinder and make contribution to combustion but a part of it is deposited on the wall of the intake manifold pipe. The fuel deposited thereon is not problematic because its quantity is constant in a stationary state after the engine is warmed up, but is problematic in the transient state just after the engine starts. Particularly when the engine is starting at very low temperature, more fuel is generally injected in order to avoid misfire and the like, and the operating state rapidly changes, for example, temperature rises in the intake manifold pipe, the dynamic characteristic of fuel deposit correspondingly and greatly changes. For this reason, it is necessary that the fuel injection quantity be controlled when the engine is starting so that the target A/F ratio is obtained.

Figure 8:
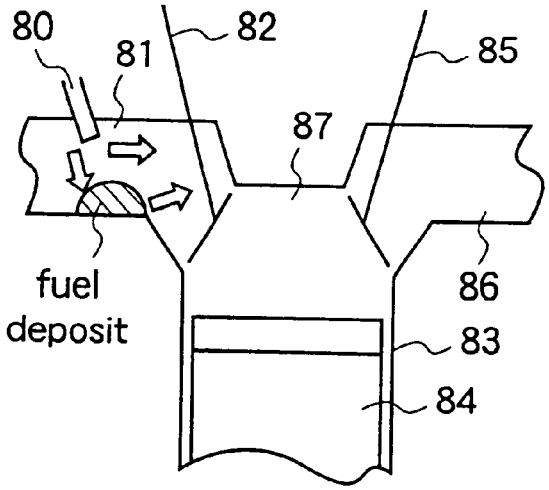
FIGS. 8(*a*) and 8(*b*) are diagrams showing a model of fuel deposit on an intake manifold pipe for use by an A/F ratio control device according to a third embodiment of the present invention.
Figure 8:
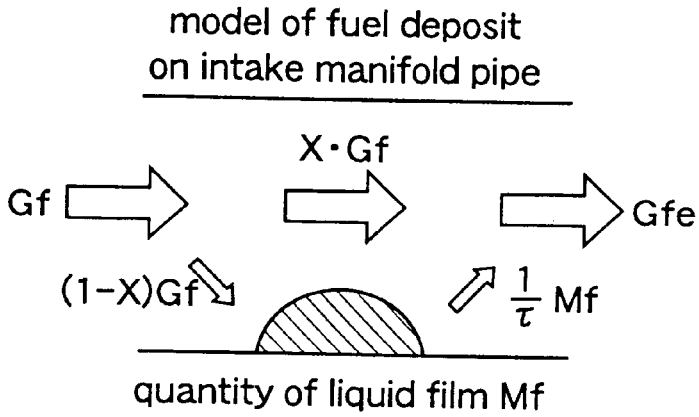

FIG. 8 is a conceptual view showing fuel deposit. In FIG. 8(*a*), reference numeral 80 designates a fuel injection nozzle (injector) for injecting the fuel into an intake manifold pipe 81, 83 designates a cylinder block which accommodates a piston 84, and 86 designates an exhaust pipe connected to the cylinder block 83. A space in the cylinder block 83 which is surrounded by the piston 84, an air suction valve 82, and an exhaust valve 85, is a combustion chamber 87. Assuming that the fuel injection quantity, the ratio of the quantity of the fuel directly flowing into the cylinder to the fuel injection quantity, the quantity of fuel deposited on the intake manifold pipe, an evaporation time constant which represents a dynamic characteristic in which the fuel deposited on the intake manifold pipe evaporates and enters the cylinder, and the quantity of fuel flowing into the cylinder, are Gf, X, Mf, τ, and Gfe, respectively, the fuel deposit model is represented by means of the following expressions:

$$Gfe=X\cdot Gf+(1/\tau)\cdot Mf$$

$$dMf/dt=(1/\tau)\cdot Mf+(1-X)\cdot Gf$$

If the above expressions are made to be discrete and the "Mf" is deleted, then the following expression is presented:

$$Gf=\{z-(1-b)\}\cdot Gfe/\{a\cdot z-(a-b)\}=H(z)\cdot Gfe, \quad (1)$$

where a=X, and b=(1/τ).

Figure 9:
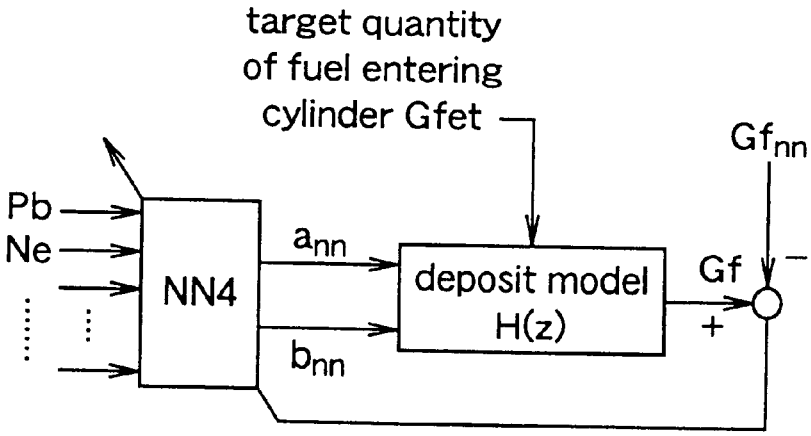
FIG. 9 is a diagram for explaining a method for deriving parameters of fuel deposit on the intake manifold pipe performed by the A/F ratio control device of the third embodiment.

FIG. 9 shows an example of a method for deriving parameters of this deposit model by the use of a neuro-engine model at the starting of the engine, according to the present invention.

In FIG. 9, an NN4 is a neural network which outputs deposit parameters a and b. Based on the outputs $a_{nn}$ and $b_{nn}$ of the NN4, a target quantity Gfet of fuel flowing into the cylinder, and a deposit model H(z), the fuel quantity Gf is calculated, which is compared to the target fuel quantity $Gf_{nn}$ from which the target A/F ratio is obtained, which has been calculated with the use of the neuro-engine model for the transient state at the starting of the engine, and a coupling coefficient of the neural network NN4 is corrected and learned so that error between them becomes zero.

Figure 10:
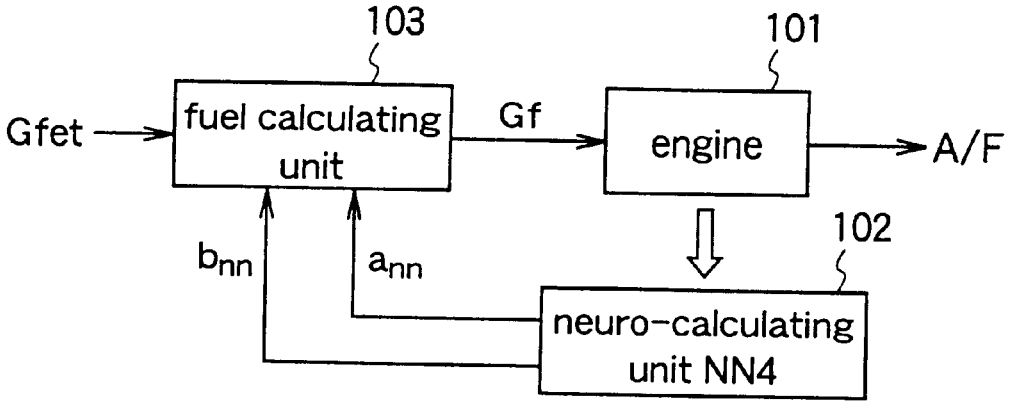
FIG. 10 is a diagram showing construction of a fuel injection control system using a neural network as the A/F ratio control device of the third embodiment.

FIG. 10 shows construction of a fuel injection control system using the neural network NN4. Turning to FIG. 10, an engine 101 detects operating state parameters as data input to the neural network NN4. A calculating unit 102 of the NN4 estimates deposit parameters $a_{nn}$ and $b_{nn}$. Based on these estimated parameters and the target quantity Gfet, the calculating unit 103 calculates the fuel injection quantity Gf from which the target A/F ratio is obtained.

These calculated parameters are sawtooth-shaped if the resulting points are merely connected, and therefore are filtered by a low-pass filter or the like to be smoothed and be of a curved shape, to suppress variations from cylinder to cylinder or errors due to noise.

Thus, in accordance with the third embodiment, with the use of the neuro-engine model representing the dynamic characteristic of the A/F ratio at the starting of the engine the fuel injection quantity at the starting of the engine is calculated based on the parameters of the intake manifold pipe deposit at the starting of the engine and the intake manifold pipe deposit model at the starting of the engine. Therefore, it is possible to uniquely determine the fuel injection quantity so that the quantity of fuel flowing into the cylinder matches the target quantity(combustion result A/F= the target A/F).

Embodiment 4.

A description will be given of an A/F ratio control device according to a fourth aspect of the present invention. When the engine is starting at very low temperature, a part of the fuel flowing into the cylinder remains in the inside of the cylinder without being burned. To control the A/F ratio with higher precision, there is a need for constructing a model of fuel deposit on the inside of the cylinder (cylinder deposit model).

Figure 11:
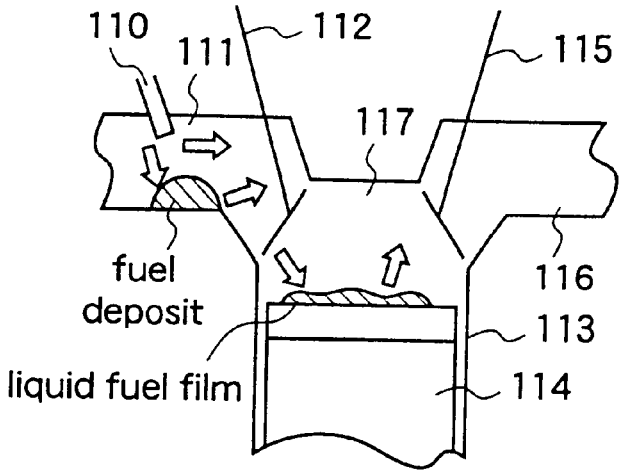
FIGS. 11(*a*) and 11(*b*) are diagrams for explaining a model of fuel deposit on inside of a cylinder for use by the A/f ratio control device of a fourth embodiment.
Figure 11:
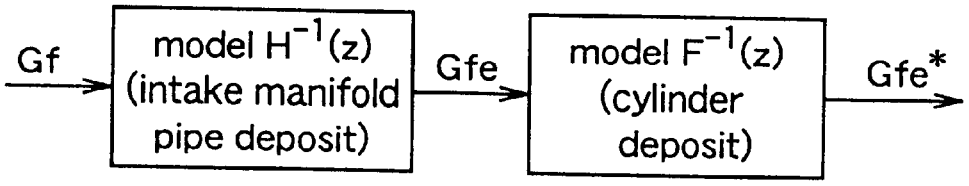

FIGS. 11(*a*) and 11(*b*) are conceptual views showing fuel deposit on the inside of the cylinder. In FIG. 11 (*a*) reference numeral 110 designates a fuel injection nozzle (injector) for injecting the fuel into an intake manifold pipe 111, 113 designates a cylinder block which accommodates a piston 114, and 116 designates an exhaust pipe connected to the cylinder block 113. A space in the cylinder block 113 which is surrounded by the piston 114, an air suction valve 112, and an exhaust valve 115, is a combustion chamber 117. All of the fuel Gfe flowing into the cylinder does not make contribution to combustion but is deposited on the head of the cylinder or the like, a liquid fuel being left thereon. Hence, the cylinder deposit model is handled like the intake manifold pipe deposit model as shown in FIG. 11(*b*), and is expressed as:

$$Gfe=[z-(1-d)\}\cdot Gfe^*/\{c\cdot Z-(c-d)\}=F(z)\cdot Gfe^* \quad (2)$$

where c is the ratio of the quantity of fuel which has contributed to combustion to the quantity of fuel entering the cylinder, d is an inverse number of the evaporation time constants when fuel of the liquid fuel film deposited on the cylinder head evaporates, and Gfe* is the quantity of fuel burned in the cylinder.

From the above expressions (1) and (2), the following expression is derived.

$$Gf=H(z)\cdot F(z)\cdot Gfe^*$$

Figure 12:
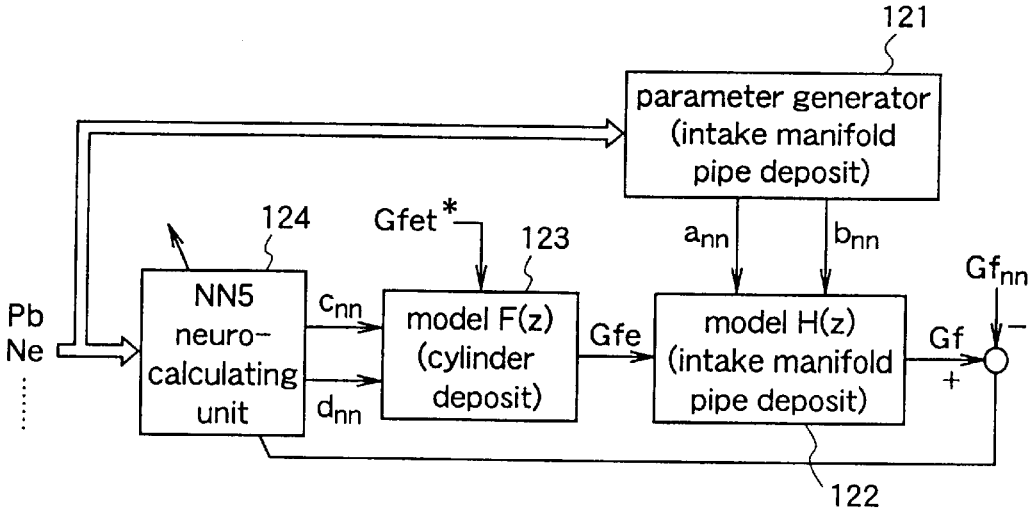
FIG. 12 is a diagram for explaining a method for deriving parameters of fuel deposit on the cylinder for a transient state at the starting of the engine by the use of a neuro-engine model performed by the A/f ratio control device of the fourth embodiment.

FIG. 12 shows an example of a method for deriving parameters of this model (cylinder deposit model) by the use of a neuro-engine model at the starting, which is included in an A/F ratio control device according to the fourth embodiment of the present invention.

In FIG. 12, an NN5 calculating unit 124 is a neural network which outputs parameters c and d of fuel deposit on the cylinder. Based on parameters $C_{nn}$ and $d_{nn}$ of the unit 124, the target quantity Gfet* of fuel entering the cylinder, and a deposit model (cylinder) F(z) 123, the quantity Gfe of fuel entering the cylinder is calculated. Then, based on outputs $a_{nn}$ and $b_{nn}$ of a parameter generator 121 for generating parameters of fuel deposit on the intake manifold pipe, the fuel quantity Gfe, and a model H(z) 122 of fuel deposit on the intake manifold pipe, the fuel injection quantity Gf is calculated, which is compared to the fuel injection quantity $Gf_{nn}$ at the starting of the engine for the target A/F ratio, which has been calculated with the use of the neuro-engine model for this state, and a coupling coefficient of the neural network NN5 is corrected and learned so that error between them becomes zero.

Figure 13:
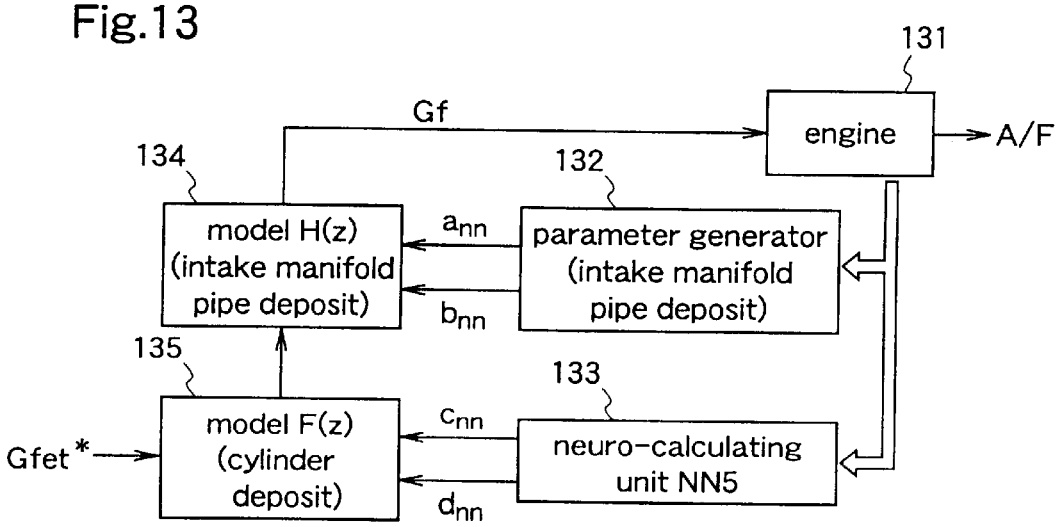
FIG. 13 is a diagram showing construction of a fuel injection control system using a neural network as the A/f ratio control device of the fourth embodiment.

FIG. 13 shows construction of a fuel injection control system using the neural network NN5. An engine 131 detects operating state parameters and supplies these to a parameter generator 132 for generating parameters of fuel deposit on the intake manifold pipe and an NN5 calculating unit 133, which calculate parameters $a_{nn}$ and $b_{nn}$ and parameters $C_{nn}$ and $d_{nn}$, respectively. Based on these estimated parameters, the target quantity Gfet* of fuel to-be-burned in the cylinder, a model H(z) 134 of intake manifold pipe deposit, and a model F(z) 135 of cylinder deposit, the fuel injection quantity Gf from which the target A/f ratio is obtained is calculated.

The calculated parameters are sawtooth-shaped if the resulting points are merely connected, and therefore are filtered by low-pass filter or the like to be smoothed and be of a curved shape, to suppress variations from cylinder to cylinder or errors due to noise as in the case of the third embodiment.

The parameter generator 132 also may be constructed by a neural network.

Thus, in accordance with the fourth embodiment, the intake manifold pipe deposit model and the cylinder deposit model are introduced, which allows more accurate representation of complicated behavior of the engine at the starting, and thereby controllability for the A/F ratio is further improved.

The cylinder deposit model may be constructed as follows.

With the use of the neuro-engine model at the starting of the engine, the intake manifold pipe deposit model and the parameters of cylinder deposit are derived, considering evaporation temperature of gasoline. This will be described below.

Figure 14:
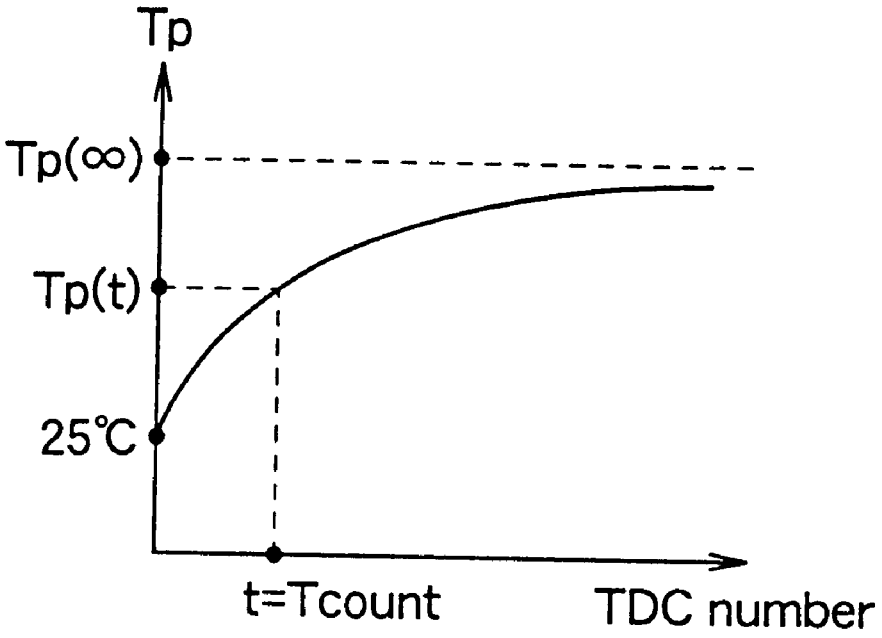
FIG. 14 is a graph showing the relationship between the number of TDCs after the engine starts and temperature of the wall of the cylinder in the A/f ratio control device of the fourth embodiment.
Figure 15:
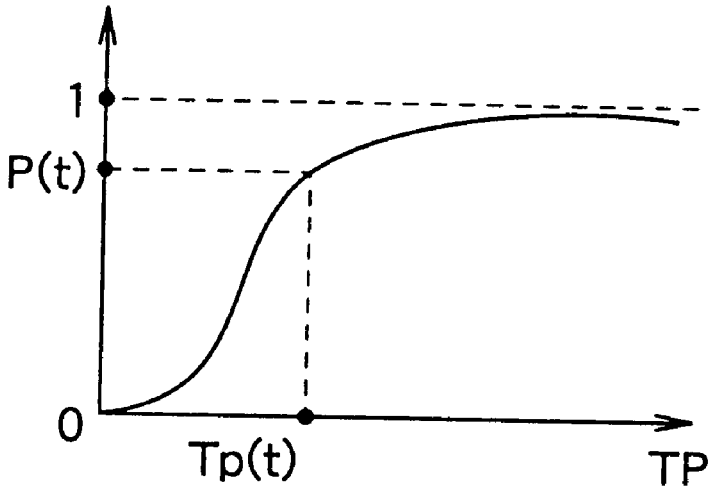
FIG. 15 is a graph showing the relationship between an evaporation rate of gasoline and the temperature of the wall of the cylinder in the A/F ratio control device of the fourth embodiment.

The evaporation rate of gasoline increases with increasing temperature of the wall of the cylinder. This is known in advance and therefore is used as transcendental knowledge. FIG. 14 shows the relationship between the temperature of the wall and the number of TDCs, i.e., Tcount. In FIG. 14, the Tcount may be replaced by the number of times of explosion. The evaporation rate P(P(t))of gasoline, as shown in FIG. 15, becomes closer to "1" (The fuel inside the cylinder makes 100% contribution to combustion) as the temperature Tp of the wall of the cylinder increases.

Figure 16:
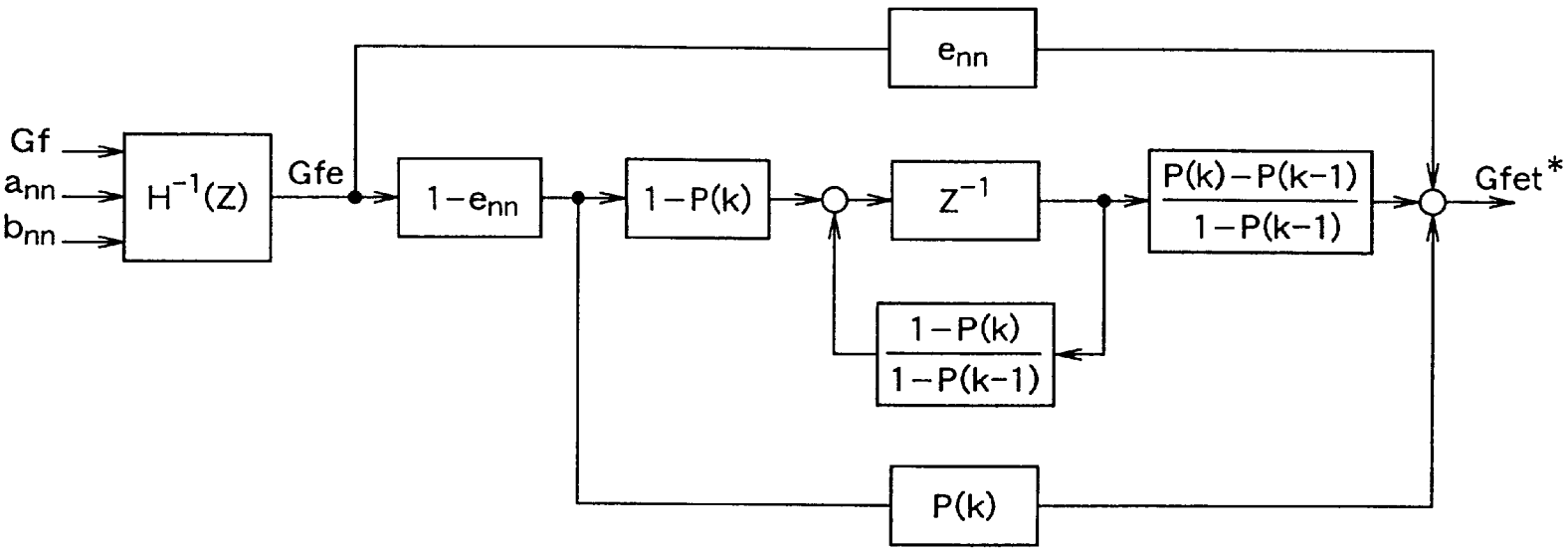
FIGS. 16(*a*) and 16(*b*) are diagrams showing a model of fuel deposit on the wall of the cylinder considering a dynamic characteristic of the evaporation rate of gasoline as the A/f ratio control device of the fourth embodiment.
Figure 16:
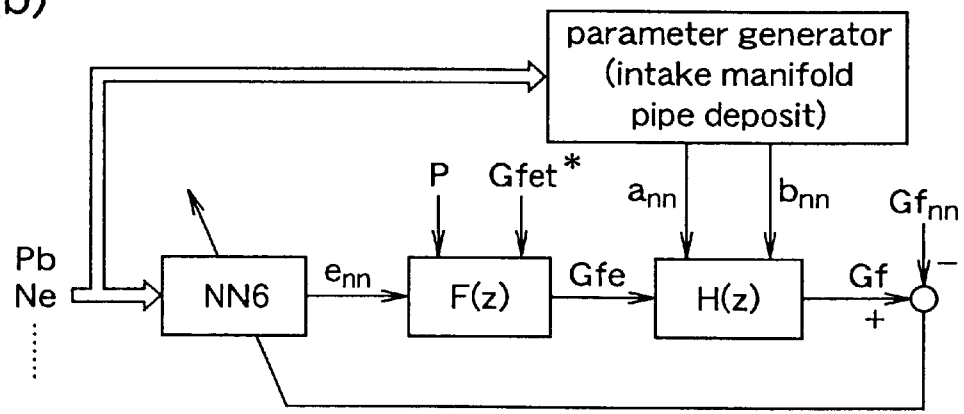

The cylinder deposit model considering this dynamic characteristic of the evaporation rate P is illustrated in FIG. 16(*a*). As shown in FIG. 16(*b*), in the same manner as shown in FIG. 12, from the evaporation rate P, the estimated parameters $a_{nn}$ and $b_{nn}$ and the target fuel quantity Gfet* of fuel to-be-burned in the cylinder, a rate $e_{nn}$ of contribution to combustion is derived with the use of the neural network.

Thus, the intake manifold pipe deposit model and the cylinder deposit model are constructed considering the evaporation temperature of gasoline (transcendental knowledge). Therefore, these models are adapted to physical characteristics, and thereby control precision is further improved.

In addition, this construction reduces the number of derived parameters of the cylinder deposit model. Embodiment 5.

A description will be given of an A/F ratio control device according to a fifth embodiment of the present invention. The method for deriving parameters with the use of the NN according to the third embodiment does not guarantee stability of an onboard NN which operates every time. Hence, there is a possibility that controllability is degraded due to the rapid change of the parameters output from the NN caused by disturbance and the like.

Figure 17:
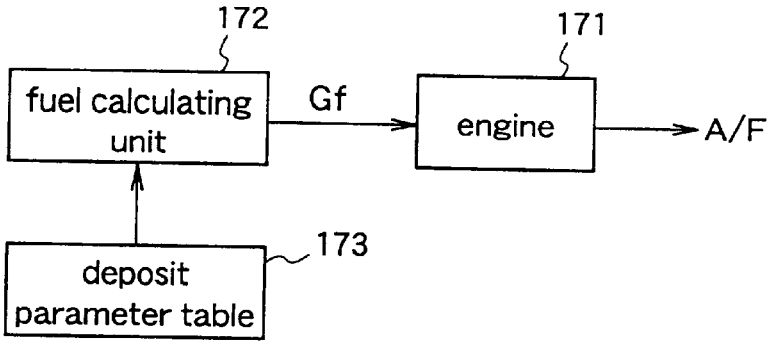
FIG. 17 is a functional block diagram showing an A/f ratio control device which controls the A/F ratio by the use of deposit parameter coefficients given as time series data according to a fifth embodiment of the present invention.

Accordingly, as shown in FIG. 17, a deposit parameter table 173 lists the deposit parameters at the starting of the engine which have been found by the NN as a time series data map given according to the number of times of explosion in the cylinder after the engine starts, and from the deposit parameters (time series data), a fuel calculating unit 172 calculates the fuel injection quantity Gf from which the target A/F ratio is obtained. For instance, the data map may be a time series data map given according to the number of TDCs just after the piston of an engine 171 starts operation. A signal indicating the TDC is obtained as a pulse signal by a crank angle sensor.

Thus, in accordance with the fifth embodiment, the deposit parameters found with the use of the NN engine model are handled as the time series data map given according to the number of the TDCs. Thereby, it is possible to control the A/F ratio stably without being affected by disturbance and the like during the state at the starting of the engine.

While the time series data map is created by using the TDCs detected by the crank angle sensor as a time axis, the number of times of explosion detected by the inner pressure sensor may be used as the time axis. Use of the cylinder pressure sensor can accurately detect an explosion in the cylinder because the TDC might be detected even when misfire occurs, and thereby the A/F ratio can be controlled with high precision and reliability.

Embodiment 6.

A description will be given of an A/F ratio control device according to a sixth embodiment of the present invention. The method for deriving parameters with the use of the NN does not guarantee stability of the onboard NN. Hence, there is a possibility that controllability is degraded due to the rapid change of the parameters output from the NN caused by disturbance. Although this problem can be solved by creating the table which lists the parameters of fuel deposit on the intake manifold pipe which have been derived with the use of the NN as already described, another problem with this case still remains unsolved. The problem is that toughness (stability)of the A/F ratio control is reduced during the transient state at the starting of the engine.

Figure 18:
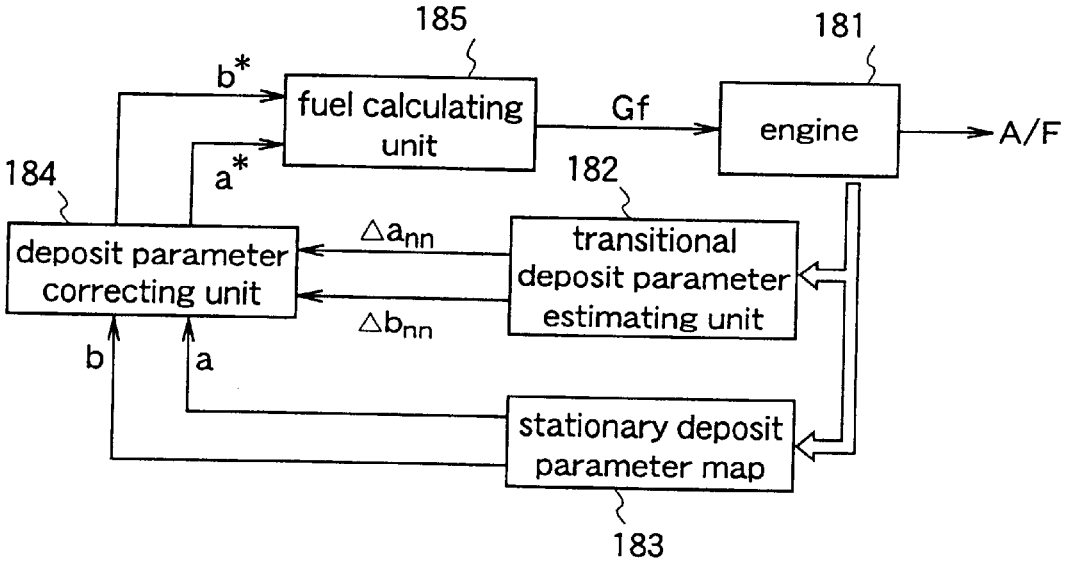
FIG. 18 is a functional block diagram showing an A/f ratio control device according to a sixth embodiment of the present invention.

Hence, as shown in FIG. 18, there are provided a stationary deposit parameter map 183 which contains deposit parameters (basic deposit parameters) a and b of an engine 181 in a stationary state as map data (Ne, Pb, TW, TA) found through an experiment and outputs these parameters depending upon operating states, a transitional deposit parameter estimating unit 182 for estimating variations of the deposit parameters for the transient state with the use of the NN, a deposit parameter correcting unit 184 for correcting the basic deposit parameters a and b by estimation values A $a_{nn}$ and $\Delta b_{nn}$ and outputting the resulting corrected parameters a* and b*, and a fuel calculating unit 185 for calculating the fuel injection quantity Gf based on these corrected parameters a* and b* and the intake manifold pipe deposit model, for controlling the A/F ratio during the transient state so that the target A/F ratio is obtained.

Thus, in accordance with the sixth embodiment, the basic deposit parameters for the stationary state are given as the map data (Ne, Pb, TW, TA) obtained through the experiments, and the deposit parameters estimated by the NN for the transient state are used to correct the basic deposit parameters. Thereby, accuracy of the A/f ratio estimation for the transient state and toughness (stability) of the A/F ratio control during the transient state are increased, in contrast with the case where only the time series map data is used like the first embodiment.

While the variations in the deposit parameters for the transient state are estimated by the NN, the estimation values $\Delta a_{nn}$ and $\Delta b_{nn}$ may be given in time series.

Embodiment 7.

A description will be given of an A/F ratio control device according to a seventh embodiment of the present invention. The method for deriving parameters of fuel deposit on the intake manifold pipe with the use of the NN does not guarantee stability of the on-board NN. Hence, there is a possibility that controllability is degraded due to the rapid change of the parameters output from the NN caused by disturbance. In addition, although this problem can be solved by creating the table which lists the deposit parameters of fuel deposit on the intake manifold pipe, toughness (stability)of the A/F ratio control is reduced during the transient state at the starting of the engine.

Figure 19:
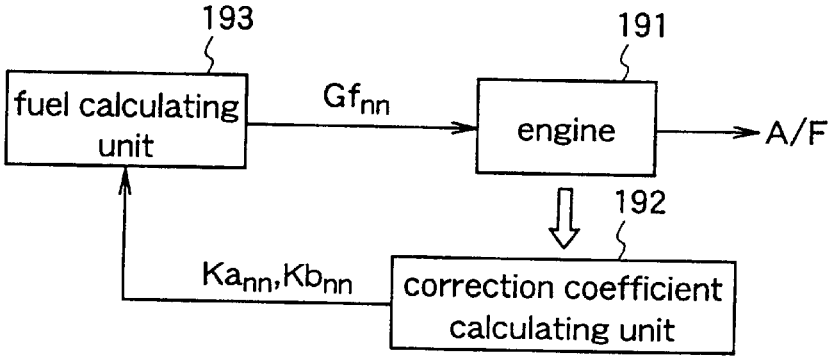
FIG. 19 is a functional block diagram showing an A/f ratio control device according to a seventh embodiment of the present invention.

Accordingly, as shown in FIG. 19, there are provided a correction coefficient calculating unit 192 (calculating unit) for calculating correction coefficients $Ka_{nn}$ and $Kb_{nn}$ and a fuel calculating unit 193 for calculating fuel injection quantity for the transient state based on the basic deposit parameters a and b, the correction coefficients $Ka_{nn}$ and $Kb_{nn}$ and the fuel deposit model, for controlling the A/F ratio so that the target A/F ratio is obtained.

The correction coefficients $Ka_{nn}$ and $Kb_{nn}$ are calculated from the target fuel injection quantity $Gf_{nn}$ found by the neuro-engine model and the intake manifold pipe deposit model. The deposit parameters $a_{nn}$ and $b_{nn}$ used by the calculating unit 193 are given by:

$$ann=a*Ka_{nn},\ \mathrm{bnn}*\mathrm{Kb}_{nn}$$

The calculating unit 192 may give the correction coefficients as the time series data for the transient state at the starting of the engine.

Thus, in accordance with the seventh embodiment, the correction coefficients at the starting of the engine are found to be used to correct the deposit parameters and the resulting corrected deposit parameters are used. Thereby, accuracy of the A/f ratio control for the transient state and toughness of the A/F ratio control during the transient state are increased, in contrast with the case where only the time series map data is used like the first embodiment.

What is claimed is:

1. A control device for use with an internal combustion engine and for use in controlling an air-to-fuel ratio when fuel is injected in the internal combustion engine, said control device comprising:

a parameter map operable to store basic deposit parameters for a stationary state in which the engine is operating;

a parameter estimating unit operable to estimate variations in deposit parameters for a transient state in which the engine is starting, based on a neural network;

a parameter correcting unit operable to correct the basic deposit parameters according to the variations estimated by said parameter estimating unit; and a fuel calculating unit operable to calculate fuel injection quantity based on the corrected basic deposit parameters and a fuel deposit model.

2. A control device for use with an internal combustion engine and for use in controlling an air-to-fuel ratio when fuel is injected in the internal combustion engine, said control device comprising:

a parameter calculating unit operable to calculate fuel deposit parameters at the starting of the engine based on a target fuel injection quantity, which is previously determined based on a neuro-engine model representing a dynamic characteristic of an air-to-fuel ratio at the starting of the engine, and an intake manifold pipe deposit model at the starting of the engine, wherein the target fuel injection quantity is to be used to obtain a target air-to-fuel ratio; and a fuel calculating unit operable to calculate fuel injection quantity at the starting of the engine based on the fuel deposit parameters and the intake manifold pipe deposit model.

3. The control device of claim 2 wherein:

said parameter calculating unit is operable to derive parameters of a cylinder deposit model at the starting of the engine based on a neuro-engine model representing a dynamic characteristic of the air to fuel ratio at the starting of the engine, and said fuel calculating unit is operable to calculate the fuel injection quantity at the starting of the engine based on parameters of intake manifold pipe deposit, the parameters of cylinder deposit, the intake manifold pipe deposit models and the cylinder deposit model at the starting of the engine.

4. The control device of claim 3, wherein:

said parameter calculating unit is operable to derive the parameters of the intake manifold pipe deposit model and the parameters of cylinder deposit model at the starting of the engine, while taking evaporation temperature of gasoline into account, based on the neuro-engine model representing the dynamic characteristic of the air-to-fuel ratio at the starting of the engine.

5. A control device for use with an internal combustion engine and for use in controlling an air-to-fuel ratio when fuel is injected in the internal combustion engine, said control device comprising:

a parameter map operable to store fuel deposit parameters at the starting of the engine;

a correction coefficient calculating unit operable to calculate correction coefficients for correcting the fuel deposit parameters at the starting of the engine so as to obtain a target air-to-fuel ratio at the starting of the engine; and a fuel calculating unit operable to calculate fuel injection quantity at the starting of the engine based on the fuel deposit parameters, the correction coefficients, and a fuel deposit model.

6. The control device of claim 5, wherein:

said correction coefficient calculating unit is operable to calculate the correction coefficients based on a neural network engine model at the starting of the engine.

7. The control device of claim 5 wherein the correction coefficients are data given in time series just after the engine starts.

8. A control device for use with an internal combustion engine and for use in controlling an air-to-fuel ratio when fuel is injected in the internal combustion engine, said control device comprising:

a parameter map operable to store fuel deposit parameters at the starting of the engine as time series data; and a fuel calculating unit operable to calculate a fuel injection quantity from the fuel deposit parameters stored in said parameter map wherein the fuel injection quantity is to be used to obtain a target air-to-fuel ratio at the starting of the engine.

9. The control device of claim 8, wherein:

the time series data in said parameter map is data that is calculated with the use of a neural network engine model.

10. The control device of claim 8 wherein the fuel deposit parameters are time series data given by using the number of times of explosion in a cylinder as a time axis, based on signals indicating that top dead centers (TDC) from the first cranking occurring when the engine is starting have been detected.

11. The control device of claim 8 wherein the fuel deposit parameters are time series data given by using the number of times of explosion in a cylinder occurring when the engine is starting as a time axis, which has been detected by a cylinder pressure sensor which detects pressures in the cylinder.

* * * * *